US007422133B2

(12) United States Patent
Nayrac et al.

(10) Patent No.: US 7,422,133 B2
(45) Date of Patent: Sep. 9, 2008

(54) GAS COMBUSTION OPERATED FASTENER DRIVING TOOL WITH CASING FLOATING AT THE FRONT END

(75) Inventors: Frederic Nayrac, Bourg les Valence (FR); Bruno Toulouse, Tain l'Hermitage (FR); Ludovic Rousson, Saint Lager Bressac (FR); Patrick Herelier, Saint Jean de Muzols (FR)

(73) Assignee: Societe de Prospection Et d'Inventions Techniques Spit, Bourg les Valence (FR)

( * ) Notice: Subject to any disclaimer, the term of this patent is extended or adjusted under 35 U.S.C. 154(b) by 0 days.

(21) Appl. No.: 11/569,566

(22) PCT Filed: May 25, 2005

(86) PCT No.: PCT/IB2005/001436

§ 371 (c)(1),
(2), (4) Date: Nov. 22, 2006

(87) PCT Pub. No.: WO2005/115696

PCT Pub. Date: Dec. 8, 2005

(65) Prior Publication Data

US 2007/0215666 A1 Sep. 20, 2007

(30) Foreign Application Priority Data

May 27, 2004 (FR) ..... 04 05713

(51) Int. Cl.
*B25C 1/04* (2006.01)

(52) U.S. Cl. ..... 227/10; 227/130; 173/170

(58) Field of Classification Search ..... 227/10, 227/130, 9, 156; 173/210, 162.1, 162.2, 173/170, 171
See application file for complete search history.

(56) References Cited

U.S. PATENT DOCUMENTS

| | | | | | |
|---|---|---|---|---|---|
| 2,888,679 | A | * | 6/1959 | Peterssen et al. | 227/130 |
| 3,099,011 | A | * | 7/1963 | Wandel | 227/130 |
| 3,601,300 | A | * | 8/1971 | Anstett | 227/8 |
| 4,475,680 | A | * | 10/1984 | Farian | 227/130 |
| 5,131,579 | A | * | 7/1992 | Okushima et al. | 227/8 |
| 5,322,131 | A | * | 6/1994 | Pressley et al. | 173/162.1 |
| 5,400,860 | A | * | 3/1995 | Best et al. | 173/162.2 |
| 5,441,192 | A | * | 8/1995 | Sugita et al. | 227/130 |
| 5,687,898 | A | * | 11/1997 | Toulouse | 227/8 |
| 5,797,534 | A | | 8/1998 | Almeras | |
| 5,813,477 | A | * | 9/1998 | Clay et al. | 173/1 |

(Continued)

FOREIGN PATENT DOCUMENTS

EP 0927610 A 7/1999

*Primary Examiner*—Scott A. Smith
(74) *Attorney, Agent, or Firm*—Lowe, Hauptman, Ham & Berner, LLP

(57) ABSTRACT

The gas-operated fixing device comprises an internal combustion engine for driving fasteners, arranged in a case (9) fitted in a handle (13) and fixed to it at the rear (14-17, 56, 21-24). The front (91) of the case (9) is fitted floating in the handle (13) so as to be able to slide in it along the drive axis (20) of the fasteners. To be more specific, the case (9) and the handle of the device (11-13) are fixed to each other by tenon (49, 50) and slot (47, 48) assemblies.

10 Claims, 3 Drawing Sheets

U.S. PATENT DOCUMENTS 5,897,043 A 4/1999 Veoukas et al.
6,123,241 A 9/2000 Walter et al.
6,668,942 B1 * 12/2003 Lin ..... 173/211
6,964,362 B2 * 11/2005 Shkolnikov et al. ..... 227/130
2002/0005290 A1 1/2002 Giardino et al.
2004/0094315 A1 5/2004 Chang

* cited by examiner

GAS COMBUSTION OPERATED FASTENER DRIVING TOOL WITH CASING FLOATING AT THE FRONT END

CROSS REFERENCE TO RELATED APPLICATIONS

The present application is based on International Application Number PCT/IB2005/001436 filed May 25, 2005, and claims priority from French Application Number 0405713 filed May 27, 2004, the disclosures of which are hereby incorporated by reference herein in their entirety.

BACKGROUND OF THE INVENTION

1. Field of the Invention

The invention lies in the sphere of internal combustion engine gas-operated fixing devices. They operate on the principle of explosion of an inflammable mixture of gas and air in the combustion chamber of the engine, formed partly of a cylinder, a cylinder sleeve and a cylinder head, to propel into the cylinder a piston for driving a fixing device.

2. Description of the Related Art

The engine is arranged in a casing.

The case is arranged in the two shells of a handle to which it is fixed both at the front and at the rear. To be more specific, at the rear, the cylinder head of the engine, the casing and the handle shells are fixed together with the same bolts.

When the inflammable mixture in the combustion chamber is under pressure, a force directed towards the rear is exerted on the cylinder head and therefore on the casing to which it is connected.

Inversely, when, under the explosion action, the piston is propelled towards the front, it stops against a damper which is connected to the cylinder. A force directed forwards is thus exerted on the cylinder and therefore on the casing to which it is connected.

In brief, the casing, generally made from plastic, is subjected to a high degree of pressure stresses, up to 60% of all these stresses.

The casing of the gas-operated fixing devices already acts as a flexible damper since it manages to stretch a little.

The applicant realized that the casing was deforming where it was easiest for it, i.e. at the front of the equipment.

Therefore, from a situation in which a gas-operated fixing device casing is integral with the handle of the device, both at the front and at the rear, the applicant conceived the idea of trying to solve the problem of separating the front of the casing from the handle so as to enable the casing to perform better its function as a damper.

So it is that the invention covered by this application is proposed.

BRIEF SUMMARY OF THE INVENTION

The invention concerns a gas-operated fixing device comprising an internal combustion engine for driving fasteners, arranged in a casing fitted in a handle and fixed to it at the rear, characterized in that the front of the casing is fitted floating in the handle to be able to slide in it along the driving axis of the fasteners.

An extra major advantage of the invention is that it eliminates a large part of the relative vibrations of the casing and the handle, which aids the components housed in the handle of the device, particularly the electronic components. It also makes everything more comfortable for the operator.

In one interesting form of making the device covered by the invention, the front of the casing is fitted so as to slide in the handle towards the front up to front stops, and advantageously towards the rear up to rear stops.

In the preferred form of the device covered by the invention, the casing and the handle of the device are fixed to each other by tenon and slot assemblies.

The tenons and slots are advantageously oblong in shape, the tenons being shorter than the slots at the front of the casing.

BRIEF DESCRIPTION OF THE DRAWINGS

The invention will be better understood by reading the following description, developed with reference to the appended drawing in which.

DETAILED DESCRIPTION OF THE PREFERRED EMBODIMENTS

Figure 1:
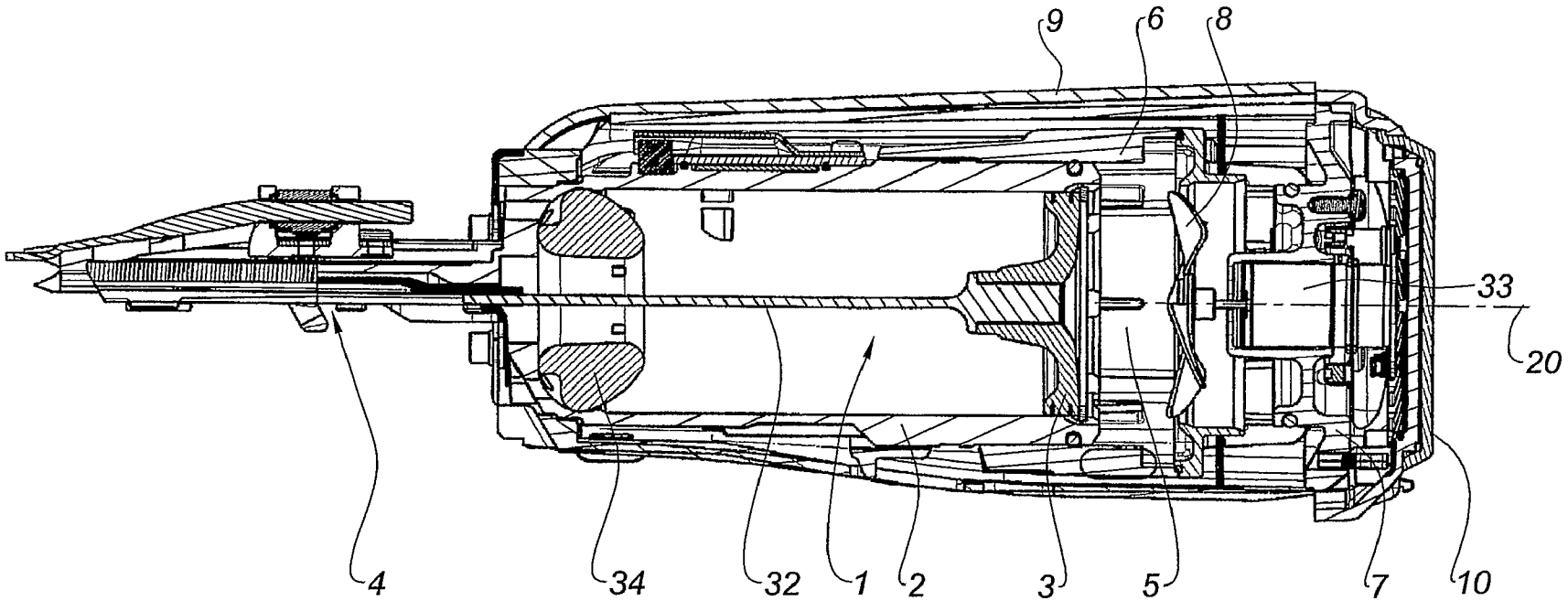
FIG. 1 is an axial section view of the fixing device of the invention.

The heat engine 1 of the device of the invention consists essentially, on the one hand, of a cylinder 2, with a centreline 20, in which a piston 3, with its rod 32, is fitted so as to slide in order to drive a fastener through a nose, or guide point, 4, of the device, and, on the other hand, a combustion chamber 5, formed at the rear of the cylinder 2, of a cylinder sleeve 6, the drive piston 3 and a cylinder head 7. A fan 8 for stirring the inflammable mixture, draining and cooling, is arranged in the chamber 5, its electric motor 33 being housed in the cylinder head 7, beyond which a spark plug (not shown) projects into the chamber. In its forward stroke the piston 3 abuts against a shock absorber 34 arranged at the front end of the cylinder.

Figure 2:
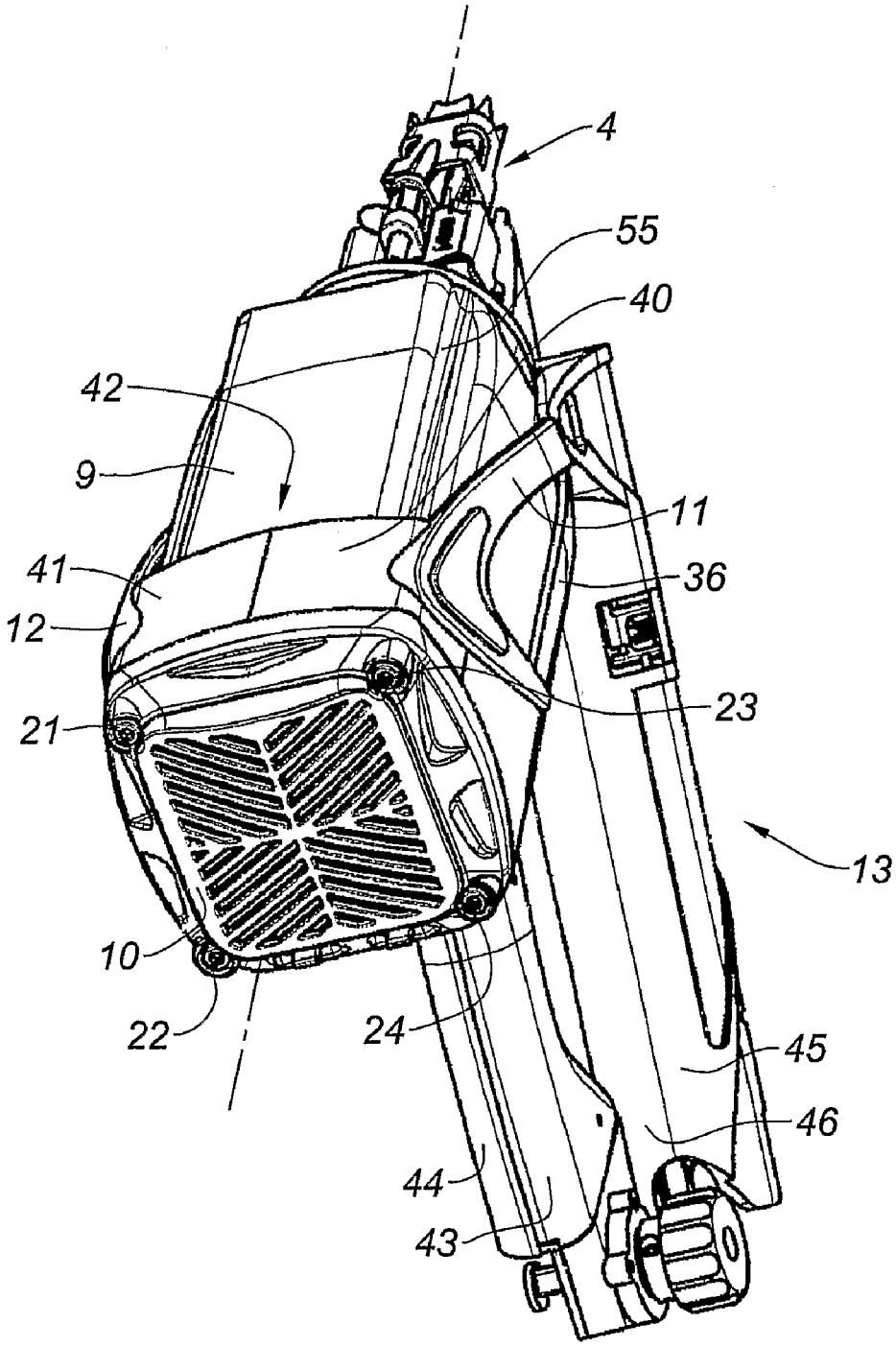
FIG. 2 is a rear perspective view of the device of the invention.

The heat engine is arranged in a casing 9 closed at the rear by a ventilation cover 10 and two shells 11, 12 of a handle 13. To be more precise, the casing has four angle grooves such as groove 55 in FIGS. 2 and 3, ending at the rear with four supporting shoulders 14, 17, in each of which a smooth bore is drilled to take, driven through the bores, four bolts 21-24 for fixing the cover 10 and the handle shells 11, 12, the bolts being screwed into two pairs of tapped angle stiffeners such as the stiffener 56 in FIG. 3, formed at the rear of the shells, on their inside wall, these stiffeners being housed in the grooves 55 of the casing, supported against the shoulders 14-17. The angle stiffeners 25-28 at the rear of the shells can retain the cylinder head 7 in certain instances.

Each of the handle shells has a pierced frame 36 (37) designed to be laid against a side wall 38 (39) of the casing and, at the rear, a semi-flange 40 (41) to improve the rear covering of the casing by the two semi-flanges joined, by tongue and groove, as a fixing sleeve 42. Each shell is extended at the rear by the real handle part 43 (44) and, at the front, by a housing or supporting structure 45 (46), either for an electricity supply battery or for a fasteners charger.

Therefore, the engine 1 is arranged in the casing 9 which is fitted into the assembly of the two shells 11, 12 of the handle 13 to which it is fixed at the rear by the bolts 21-24.

Figure 3:
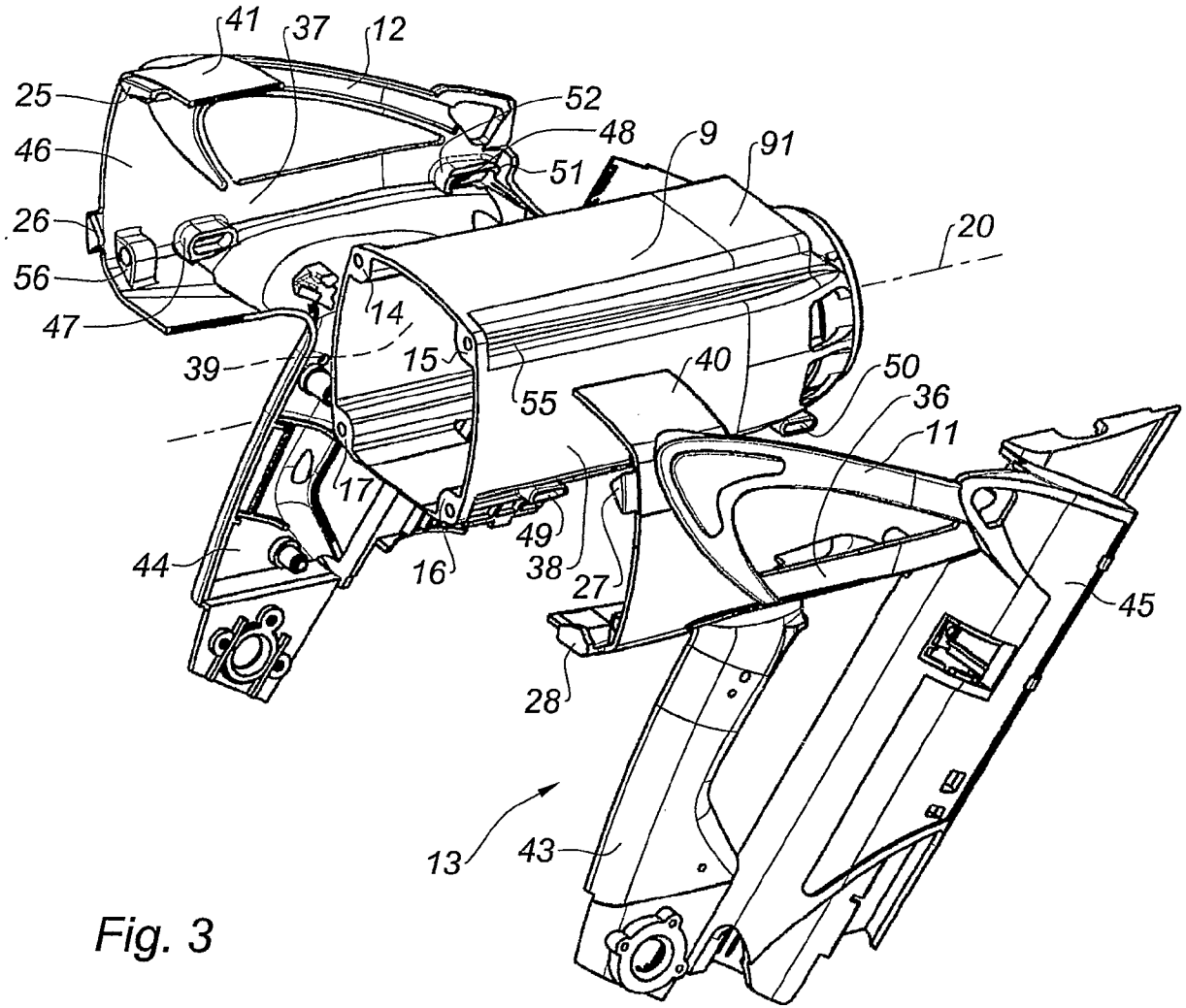
FIG. 3 is an exploded perspective view, slightly to the rear, of the casing and of the shells of the handle of the device.

On their inner surface 46, at the bottom near the handle 43, 44, the shell cheeks 36, 37 carry, from the same castings, small annular funnels, oblong in section, one 47 at the rear and another 48 at the front. FIG. 3 shows only the inside surface and the funnels of the left side cheek 37. As will already have been noted, the fixing arrangement has a plane of symmetry going through the centreline 20.

The side walls 38, 39 of the casing 9, in positions corresponding to those of the funnels 47, 48, therefore at the bottom at the front and at the rear, also have, from the same casting, small annular funnels 49, 50, also oblong in section, designed to work in conjunction by fitting into each other, like tenons and slots, with the funnels 47, 48 of the shell cheeks 36, 37. FIG. 3 shows only the funnels 49, 50 of the side wall 38 of the case 9. The rear tenons and slots 49, 47, more of less with the same inside and outside sections, fit overall more or less by force fitting into each other. On the other hand, the front tenons and slots 50, 48, fit into each other with a slight force fit in their cross dimension but not in their dimension parallel to the centreline 20. In other words, the outside axial length of the tenons 50 of the front part 91 of the case 9 is appreciably shorter than the inside axial length of the slots 48, specifically to enable axial sliding of the tenons in the slots. Thus, the front 91 of the case 9 is fitted floating in the handle 11-13 and can slide in it along the drive axis 20 of the fasteners.

Of course, the respective arrangements of the tenons and slots could be reversed, the tenons forming part of the casting of the handle shells. In all cases, the front tenons are shorter than the front slots.

The front 51 and rear 52 annular walls of the front funnel slots 48 act as front and rear stop parts for the front tenons 50 of the case.

The invention claimed is:

1. Gas-operated fixing device comprising:

a casing having an external front end and an external rear end;

an internal combustion engine for driving fasteners arranged in the casing;

a handle, the handle being fixed to the external rear end of casing so as to be immovable relative to the casing, and connected to the external front end of the casing so as to be able to be slidable relative to the casing along a drive axis of the fasteners, the casing and the handle of the device being fixed to each other by tenon and slot assemblies, and wherein the tenon and slot assemblies at the external rear end of the casing are configured so that relative movement between the tenons and the slots is prevented and wherein the tenon and slot assemblies at the external front end of the casing are dimensioned to permit relative movement between the tenon and slot in a direction parallel with the drive axis.

2. Fixing device according to claim 1, wherein the tenons and the slots are oblong in shape, the tenons being shorter than the slots at the front of the case.

3. Fixing device according to claim 1, wherein the tenons and slots are oblong in shape, the tenons being shorter than the slots at the front of the casing.

4. Fixing device according to claim 1, wherein the handle is formed in two halves, each half having a semi-flange which extends across and covers a portion of the external rear end of the casing.

5. Fixing device according to claim 4, wherein the two halves of the handle are configure to enclose sides of the casing while exposing a major portion of the external front end of the casing.

6. Gas-operated fixing device comprising:

a casing;

an internal combustion device disposed in the casing;

a handle comprising first and second shells which are configured to be pressed against opposite sides of the casing;

a first connection arrangement interconnecting the shells of the handle and the casing, in a manner wherein no relative movement between a rear end of the casing and handle is permitted, the first connection arrangement comprising first connection features formed on the housing and second connection features formed respectively on the shells, the first and second connection features being configured to engage in one another upon the shells being pressed against the sides of the casing in a manner wherein no relative movement therebetween is permitted; and a second connection arrangement interconnecting the handle and a front end of the casing in manner wherein relative movement between the front end of the casing and the handle is permitted to the degree that stress due to stretching of the casing is alleviated by sliding between the front end of the casing and the handle, the second connection arrangement comprising third and fourth connection features formed respectively on the housing and the shells, the third and fourth connection features being configured to engage in one another upon the shells being pressed against the side of the casing so that relative movement therebetween in a direction parallel to a centerline of the housing is permitted.

7. Gas-operated fixing device comprising:

a casing;

an internal combustion device disposed in the casing and configured to drive fastening elements in response to combustion of a combustible mixture driving a piston toward a front end of the casing;

a handle; and means for connecting the handle to the casing and for reducing stress on the handle in response to stretching of the casing during operation of the gas operated fixing device, the connecting means including a first connection distal from the front end of the casing which first connection prevents relative movement between the casing and the handle and a second connection proximate the front end of the casing with permits relative movement between the handle and the casing.

8. Fixing device according to claim 7, whereby the external front end of the casing is fitted for sliding in the handle forward to front stopping means.

9. Fixing device according to claim 7, whereby the external front end of the casing is fitted for sliding in the handle rearward to rear stopping means.

10. Fixing device according to claim 7, wherein the casing and the handle of the device are fixed to each other by tenon and slot assemblies.

* * * * *